US008360999B2

(12) United States Patent
Leung et al.

(10) Patent No.: US 8,360,999 B2
(45) Date of Patent: Jan. 29, 2013

(54) MAGNETIC LEVITATION VIBRATION SYSTEMS AND METHODS FOR TREATING OR PREVENTING MUSCULOSKELETAL INDICATIONS USING THE SAME

(75) Inventors: Kwok-Sui Leung, Hong Kong (CN); Wing-Hoi Cheung, Hong Kong (CN); Kam-Fai Tam, Hong Kong (CN); Wai-Kin Ng, Hong Kong (CN)

(73) Assignee: The Chinese University of Hong Kong, Hong Kong (CN)

( * ) Notice: Subject to any disclaimer, the term of this patent is extended or adjusted under 35 U.S.C. 154(b) by 1335 days.

(21) Appl. No.: 11/868,441

(22) Filed: Oct. 5, 2007

(65) Prior Publication Data

US 2009/0091410 A1 Apr. 9, 2009

(51) Int. Cl.
*A61H 1/00* (2006.01)

(52) U.S. Cl. ..... 601/78; 601/49; 601/66

(58) Field of Classification Search ..... 601/23, 601/24, 30, 31, 46, 49, 53, 54, 78, 84, 86, 601/89, 90, 93, 97, 100, 101, 66; 5/108, 5/607–610, 693, 906, 719, 915; 385/229, 385/231

See application file for complete search history.

(56) References Cited

U.S. PATENT DOCUMENTS 6,966,083 B1 11/2005 Cheng
2003/0220556 A1* 11/2003 Porat et al. ..... 601/84
2005/0131319 A1 6/2005 Van der Meer
2005/0251068 A1 11/2005 Mor
2006/0094990 A1 5/2006 Kim et al.
2006/0241528 A1 10/2006 Talish
2008/0015476 A1 1/2008 Talish et al.
2008/0015477 A1 1/2008 Talish et al.

FOREIGN PATENT DOCUMENTS

CN 1723822 A 1/2006
CN 1969789 A 5/2007
CN 2917628 Y 7/2007
EP 1 762 212 A1 3/2007

OTHER PUBLICATIONS

Roelants et al. "Whole-Body-Vibration Training Increases Knee-Extension Strength and Speed of Movement in Older Women." Journal of American Geriatrics Society 52: 901-908, 2004.
Ward et al. "Low Magnitude Mechanical Loading is Osteogenic in Children With Disabling Conditions." Journal of Bone and Mineral Research 19: 360-369, 2004.

(Continued)

*Primary Examiner* — Quang D Thanh
(74) *Attorney, Agent, or Firm* — Knobbe Martens Olson & Bear LLP

(57) ABSTRACT

A magnetic levitation vibration system comprising a top plate, a base plate, at least one first magnet, at least one second magnet, at least one electromagnetic actuator comprising an upper half and a lower half, a controller, a sensor, and a control circuit. A method for the treatment or prevention of musculoskeletal indications comprising providing a top plate, providing a base plate, generating a first magnetic field to levitate the top plate, generating a second magnetic field to drive the top plate into vibration, adjusting frequency of vibration of the top plate; and adjusting magnitude of vibration of the top plate.

25 Claims, 3 Drawing Sheets

OTHER PUBLICATIONS

Gilsanz et al. "Low-Level, High-Frequency Mechanical Signals Enhance Musculoskeletal Development of Young Women With Low BMD." Journal of Bone and Mineral Research 21: 1464-1474, 2006.

Van Nes et al. "Short-Term Effects of Whole-Body Vibration on Postural Control in Unilateral Chronic Stroke Patients." American Journal of Physical Medicine & Rehabilitation 83: 867-873, 2004.

Schuhfried et al. "Effects of whole-body vibration in patients with multiple sclerosis: a pilot study." Clinical Rehabilitation 19:834-842, 2005.

International Search Report for corresponding PCT Application No. PCT/CN2008/001629, dated Jan. 8, 2009.

* cited by examiner

MAGNETIC LEVITATION VIBRATION SYSTEMS AND METHODS FOR TREATING OR PREVENTING MUSCULOSKELETAL INDICATIONS USING THE SAME

TECHNICAL FIELD

The present invention relates to an apparatus for medical treatment and a treatment process using the same, in particular to a magnetic levitation vibration system configured to prevent or treat musculoskeletal indications and the treatment process using the same.

BACKGROUND OF THE INVENTION

More and more people, especially the elderly, suffer from various musculoskeletal indications such as osteoporosis, fracture, bone loss, osteoarthritis, low back pain, neuromuscular ailment, circulation problem in lower limb and the like. The prevention and treatment for musculoskeletal indications is required.

Low magnitude and high frequency vibration has been proven to be beneficial to several musculoskeletal indications, which provides non-pharmacological treatment and prevention of osteoporosis and associated problems. Conventional low magnitude and high frequency vibration devices generally use mechanical parts (such as springs and levers) in contact with each other as a driving unit. The mechanical wear-out and metal fatigue may reduce the serviceable life and increase power consumption and the maintenance cost.

U.S. Patent Publication No. US 2006/0241528A1 discloses a system for a low profile vibrating plate, which uses magnetic fields to provide vertical vibration motion to a platform so as to allow the system to have a lower profile. This published system allows for a more compact form-factor for the vibrating plate, which allows for increased portability. Additionally, since mechanical parts are eliminated, the vibrating plate of the published system has increased reliability.

However, neither those conventional devices employing mechanic parts nor the published system of U.S. Patent Publication No. US 2006/0241528A1 addresses the issue of non-stable frequency and magnitude of vibration in view of the change of weights of users. In order to ensure the effectiveness of therapy for users having different weights, the body weight has to be measured and this parameter has to be manually input. This may introduce erratic response if there is any error in this parameter from the measurement (if not done correctly) or human input. Moreover, none of known devices provides a feasible solution to regulate the frequency and magnitude of vibration when the device is in use. Furthermore, the published system of US Patent Publication No. US 2006/0241528A1 has one set of magnets consisting of static magnets and dynamic magnets to handle the weight of the load and generation of vibration. To support user's weight (~100 kg) using ordinary electromagnet (the most popular dynamic magnet), high electricity consumption is necessary to generate the force. Besides, since no magnetic shielding facility is used in the US Patent Publication No. US 2006/0241528A1, users may be surrounded by magnetic field due to possible leakage of magnetic field, which will produce undesirable influences to the human body, as specified by WHO (Environmental Health Criteria (2007), Extremely low frequency fields, Geneva: World Health Organization, Monograph, No.238) and ICNIRP (Guidelines on limits of exposure to static magnetic fields. Health Phys. 66(1), 100-106).

SUMMARY OF THE INVENTION

In order to overcome the shortcomings of the prior art, the present invention is to provide a magnetic levitation vibration system and a medical treatment of various musculoskeletal indications. The magnetic levitation vibration system provided according to the present invention provides a frictionless and stable vibration for prevention and treatment of osteoporosis, fracture, bone loss, osteoarthritis, low back pain, neuromuscular ailment, circulation problem in lower limb and other musculoskeletal ailment. Moreover, the frequency and magnitude of vibration could be regulated during the period that the system is working.

According to an aspect of the present invention, a magnetic levitation vibration system comprises:

- a top plate having a top surface and a bottom surface;
- a base plate located under the top plate and having a top surface and a bottom surface, the top surface of the base plate facing the bottom surface of the top plate;
- at least one first magnet fixed on the bottom surface of the top plate;
- at least one second magnet fixed on the top surface of the base plate in aligning with the first magnet with an equivalent polarity facing the first magnet to maintain a repulsive force of the first and second magnets;
- at least one electromagnetic actuator comprising an upper half fixed on the bottom surface of the top plate and a lower half fixed on the top surface of the base plate in aligning with the upper half;
- a controller configured to adjust frequency of vibration of the top plate;
- a sensor configured to monitor magnitude of vibration of the top plate to generate monitored signals; and
- a control circuit electrically connected to the lower half of the actuator and configured to adjust magnitude of vibration of the top plate in response to the monitored signals.

According to another aspect of the present invention, a method for treating musculoskeletal indications comprises:

- providing a top plate having a top surface and a bottom surface;
- providing a base plate located having a top surface and a bottom surface, the top surface of the base plate facing the bottom surface of the top plate;
- generating a first magnetic field to levitate the top plate;
- generating a second magnetic field to drive the top plate into vibration;
- adjusting frequency of vibration of the top plate by means of controlling frequency of an alternating current inducing the second magnetic field; and
- adjusting magnitude of vibration of the top plate by means of controlling the current in response to monitored signals transmitted by a sensor.

According to another aspect of the present invention, a method for preventing musculoskeletal indications comprises:

- providing a top plate having a top surface and a bottom surface;
- providing a base plate located having a top surface and a bottom surface, the top surface of the base plate facing the bottom surface of the top plate;
- generating a first magnetic field to levitate the top plate;
- generating a second magnetic field to drive the top plate into vibration;

adjusting frequency of vibration of the top plate by means of controlling frequency of an alternating current inducing the second magnetic field; and adjusting magnitude of vibration of the top plate by means of controlling the current in response to monitored signals transmitted by a sensor.

The present invention can greatly reduce the risks of mechanical wear-out and metal fatigue as in spring system, generate a frictionless and stable vibration, shield the magnetic field from the interior of the system to users and outer environment, and provide low noise and low power consumption. The frequency and magnitude of vibration can be regulated to a desired level without interrupting the vibration and independent from the weight of the user. The magnetic levitation vibration system provided by the present invention is compact, light, versatile, user-friendly, minimal power consumption, low maintenance cost and inexpensive. The capabilities of the present invention meet the current needs and can be easily expanded to cater for the future requirements.

DETAILED DESCRIPTION

Hereinafter, a detailed description of the present invention will be given with reference to the appended drawings.

Figure 1:
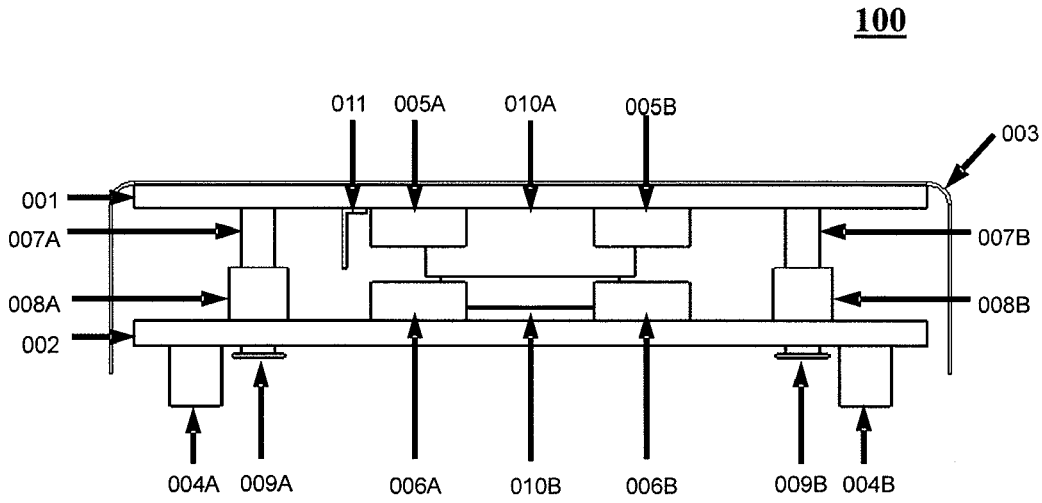
FIG. 1 is a schematic sectional view of a magnetic levitation vibration system according to an embodiment of the present invention.

FIG. 1 is a schematic sectional view of a magnetic levitation vibration system 100 according to an embodiment of the present invention. As shown in FIG. 1, the vibration system 100 includes a top plate 001 and a base plate 002. The base plate 002 can lie on the ground to provide a firm support to the vibration system 100. Optionally, a plurality of supporting items 004A, 004B, and etc. with adjustable heights could be provided on the bottom of the base plate 002 so as to ensure the system to be in a horizontal position even though the system is standing on uneven ground. The top plate 001 and the bottom plate 002 may be made of metal, alloy, plastic or other material. The user can stand with his/her feet on the top plate 001 which vibrates vertically at a certain frequency and magnitude. In this embodiment, the plates 001 and 002 are rectangular. In optional embodiments, the plates 001 and 002 may be square, circular, elliptical, triangular, and so on.

Figure 2:
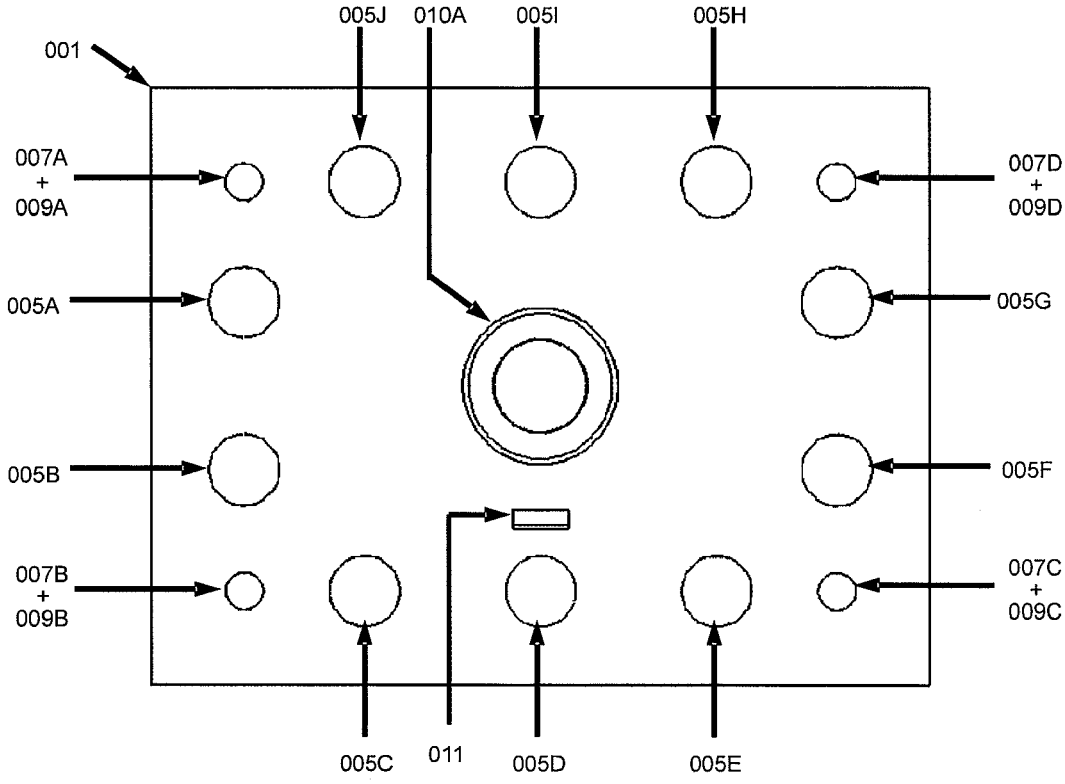
FIG. 2 is a bottom view of the top plate of the system of FIG. 1 with assembled components.
Figure 3:
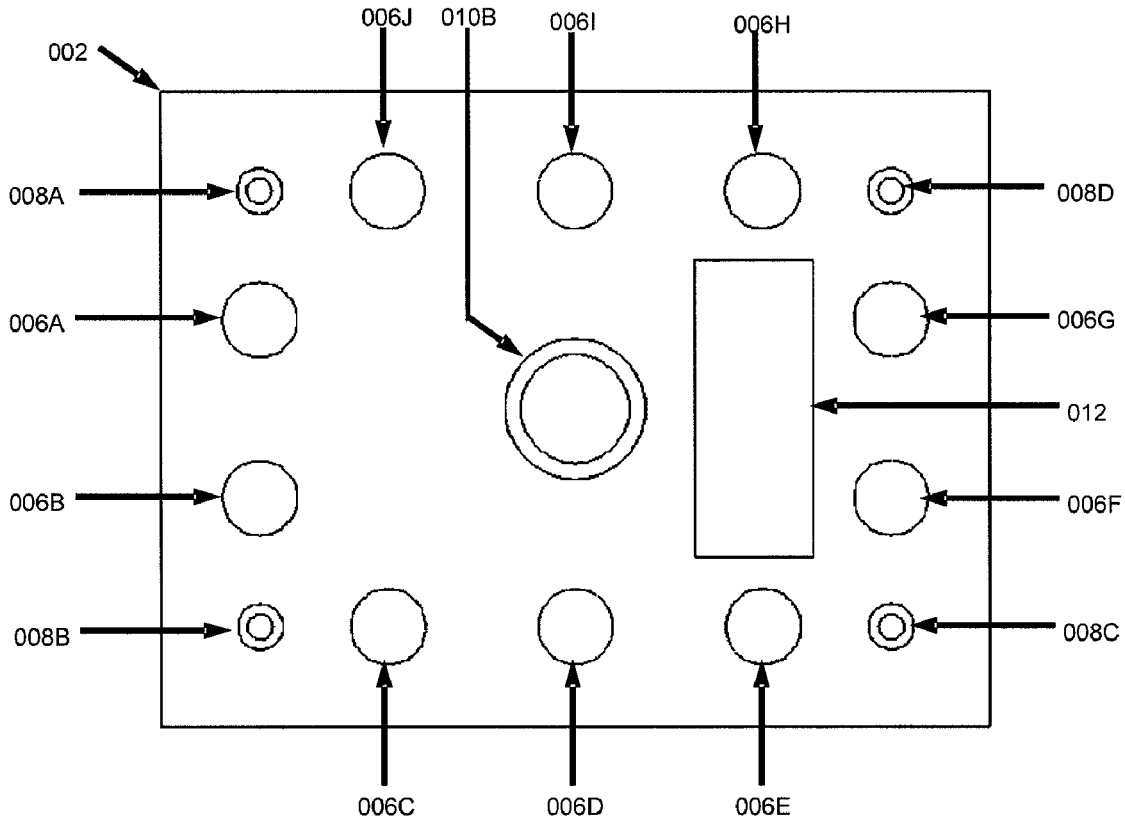
FIG. 3 is a top view of the base plate of the system of FIG. 1 with assembled components.

FIG. 2 is a bottom view of the top plate 001 with assembled components and FIG. 3 is a top view of the base plate 002 with assembled components. As shown in FIGS. 1 to 3, two sets of permanent magnets 005A-005J and 006A-006J are fixedly attached to the bottom surface of the top plate 001 and on the top surface of the base plate 002, respectively, with such an arrangement that magnets 005A-005J and the magnets 006A-006J are paired one by one and the magnets pairs like are distributed around the perimeter of the plates. The two magnets of each pair (005A/006A, 005B/006B, etc) are set with equivalent polarity facing each other so that they are in repulsion. As an example in the present invention, the magnets are each 38 mm in diameter and 15 mm in thickness, and generate magnetic field about 1 Tesla. The repulsive force among these magnet pairs can provide sufficient force (>1000N) to levitate the top plate 001 and the human body on the top plate 001.

FIG. 1 schematically shows magnets 005A and 005B, 006A and 006B only for clarity of illustration. It is understood that FIGS. 1, 2 and 3 just exemplifies the arrangement of the magnets. Those skilled in the art can arrange the magnets according to the practical requirements under the teaching of the invention.

As shown in FIGS. 1 to 3, an electromagnetic actuator comprising an upper half 010A which is a permanent magnet with an iron shell and a lower half 010B which is a coil, is provided at the central region of the plates 001 and 002. The upper half 010A is fixed on the bottom surface of the top plate 001, and the lower half 010B is fixed on the top surface of the base plate 002. The upper half 010A and the lower half 010B do not contact each other during the operation. An oscillating force is produced to drive the top plate 001 and human body into vibration when an alternating current (AC) is fed to the lower half 010B. The repulsive force and attractive force are alternately generated between the halves 010A and 010B so as to drive the top plate 001 and the human body in vibration with the frequency of the alternating current. The frequency and magnitude of the vibration can be controllable according to the electric current passing through the lower half 010B. The frequency of the alternating current can be regulated in light of a predetermined value by any known means. As an example, a controller comprising a frequency synthesizer (e.g. IC-XR2206), a capacitor and an adjustable resistor can be used for regulating the frequency of the alternating current. Furthermore, the value of the forces is controlled by the electric current passing through the lower half 010B. Since the permanent magnets 005A-005J and 006A-006J provide sufficient repulsive force to levitate the top plate 001 and the human body, the electromagnetic actuator 010 only takes charge of providing vibrating force for the load. Kinetic energy and potential energy of the whole system are converted to each other during vibration. As an example, in this embodiment, when AC current of 2 A at 35 Hz is provided, a vibration force is generated which is capable of driving 100 kg load to the vibration magnitude in excess of 0.5 g ($g \approx 9.81\ m \cdot s^{-2}$), with a vibration amplitude less than 1 mm. In the present invention, the vibration magnitude (such as 0.5 g) refers to a peak-to-peak (pk-pk) value. Specifically, the magnitude equals to the difference between the positive and negative peak values of a waveform of the vibration magnitude. For example, if the vibration magnitude is 0.5 g the positive and negative peak values are +0.25 g and −0.25 g, respectively.

In this embodiment, for general clinical indications, the frequency and magnitude of the vibration are predetermined to 35 Hz and 30% of gravity, respectively, and is adjustable at any moment in use. It should be noted that although only one electromagnetic actuator is shown, the design is not limited to one. In optional embodiments, two or more electromagnetic actuators 010 may be provided between the top plate 001 and the base plate 002, according to the specific needs in terms of vibration mode (e.g., bilateral movement), maximum vibration magnitude and loading.

The electric current passing through the lower half 010B can be regulated by an electronic circuit board 012 which may be fixed in an available space between the top plate 001 and the base plate 002. Alternatively, the electric circuit board 012 may be arranged outside of the body of the system 100. In this case, the board 012 may connect electrically with the lower half 010B by any known means. The system 100 of FIG. 1 may be provided with a screen (such as LCD or LED) configured to display the parameters like vibration frequency, vibration magnitude, preset treating time, etc., a remote control interface configured to operate the system 100 by the users, and etc. Since these configurations are conventional, the detailed description is omitted for the sake of simplifying.

A vibration sensor 011 is provided according to the invention to monitor the magnitude of vibration and transmit feedback signals to a control circuit (not shown) on the electronic circuit board 012. As shown in FIGS. 1 and 2, the sensor 011 is mounted on the bottom surface of the top plate 001 but the present invention should not be limited to this arrangement. In this embodiment, the sensor 011 is an accelerometer which can directly convert acceleration (vibration magnitude) to voltage output at 1 V/g (i.e., it outputs 1 voltage at 1 gravity). This sensor may be connected electrically to the electronic circuit board 012 by any known means. Responding to the received feedback signals, the electronic circuit board 012 adjusts in real time or periodically the current supplied to the lower half 010B so as to maintain the magnitude of vibration to a preset value. Therefore, the magnitude of vibration and hence the level of vibration stimulation applied to the human body is regulated to the desired level without interrupting the vibration and completely independent from the weight of the user.

Figure 4:
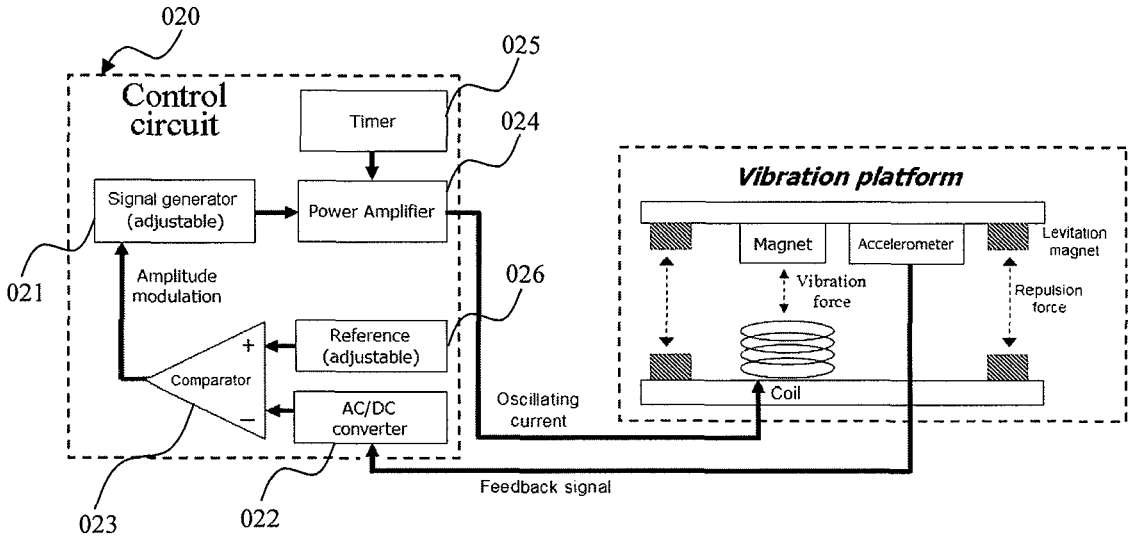
FIG. 4 is a block diagram of the control circuit operating with the vibration platform.

A block diagram is shown in FIG. 4 to illustrate that a control system utilizing the feedback sensor 011 can be installed in the electronic circuit board 012, to maintain the vibration magnitude to a predetermined target value. In this embodiment, a control circuit 020 on the electronic circuit board 012 comprises a signal generator 021, an AC/DC converter 022, a comparator 023, a power amplifier 024 and a timer 025. The signal generator 021 produces vibration signals with adjustable frequency and amplitude. The power amplifier 024 magnifies the signals to drive the electromagnetic actuator. The timer 025 controls the duration of one treatment. The comparator 023 is the control unit that can adjust the output amplitude of the signal generator 021. The output of the accelerometer 011 is conditioned by the AC/DC converter 022 to filter out vibrating voltage and pick out the level of vibration magnitude. The output of the AC/DC converter 022 is fed to the comparator 023, which compares the conditioned output voltage of the accelerometer 011 to the reference value 026 preset by the user such as 0.3 V. When the conditioned output voltage of the accelerometer 011 is below the reference value, the comparator 023 controls the signal generator 021 and increases its output amplitude (i.e., amplitude modulation); when the conditioned output voltage of the accelerometer 011 is above the reference value, the comparator 023 lowers the output amplitude of the signal generator 021. For example, the accelerometer 011 produces 0.3 V at 0.3 g of vibration so that the vibration magnitude of the platform is therefore maintained at 0.3 g.

Figure 5:
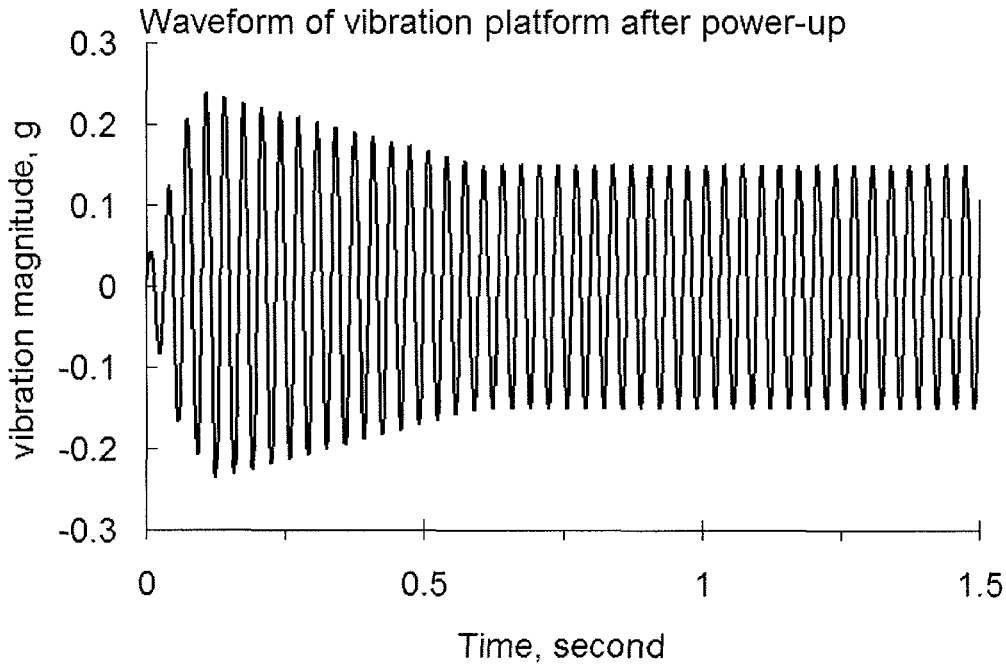
FIG. 5 is a graph of the waveform of the vibration produced by the system after it is powered up.

FIG. 5 shows the change of vibration waveform when the control circuit illustrated in FIG. 4 is first powered up, with a 70 kg human standing on the top plate 001. Just after power-up, the lower half 010B is driven fully until the vibration magnitude is above 0.3 g. It tops at 0.48 g and then quickly reduces to 0.3 g within 0.6 second after startup, and the vibration magnitude is maintained within a range of 10% of 0.3 g despite any change of balance by the load. It should be noted that this diagram merely serves to show one possible low-cost solution to provide one therapy regime at a time, and the capabilities of the present invention should not be interpreted to be limited to this diagram in any way. For example, more sophisticated circuit can attain the target vibration magnitude faster and without overshoot, and maintain the value with higher accuracy. Alternatively, programmable controller can be utilized to store different programs of therapy regimes (frequency, magnitude, duration) that best suit the specific therapeutic or health care needs.

Optionally, four guide poles 007A to 007D may be provided at the four corners on the bottom surface of the top plate 001. Correspondingly, four matching guide tubes 008A to 008D may be provided at the four corners on the top surface of the base plate 002, as shown in FIGS. 1-3, although only two sets of guide poles and tubes are shown in FIG. 1 for clarity of illustration. The inner diameter of each guide tube is slightly larger than outer diameter of each guide pole so that each guide pole can vertically move through corresponding guide tube. As long as alignment of each pair of pole and tube is arranged appropriately, the poles will move vertically within the corresponding tubes without friction each other. Thus, the top plate 001 can only vibrate vertically. This structure confines the movement of the top plate 001 relative to the base plate 002 to the perpendicular direction so as to maintain the alignments of each pair of magnets 005A-005J to 006A-006J and electromagnetic actuator halves 010A to 010B between the top plate 001 and the base plate 002 and maintain the stability of the vibration. In an alternative embodiment, four through holes are provided on the base plate 002 at the positions of the guide tubes 008A to 008D. The diameter of each through hole and the inner diameter of each guide tube are equal so that the guide poles 007A to 007D can pass through the base plate 002. Therefore, the downward movement of the top plate 001 under loading is not restricted by the base plate 002 even if the guide poles 007A to 007D are long.

Preferably, a washer 009A, 009B, 009C and 009D is provided at each of the end of guide poles 007A to 007D, as shown in FIG. 1 to prevent the guide poles 007A to 007D from drawing out of the tubes 008A to 008D so as to prevent the top plate 001 from separating from the base plate 002 when the vibration system 100 is not loaded. It should be appreciated that the washers are optional and do not impact the curative effect.

Optionally, each of the top surface of the top plate 001 and the bottom surface of the bottom plate 002 is covered with a thin metal sheet (typically made of iron and 1.5 mm in thickness) as the first shield of the magnetic field from the internal components of vibration system 100, although they are not shown in FIGS. 1 to 3 for clarity of illustration. Additionally, a housing case 003 may be provided surrounding the top plate 001 to protect the internal components of the vibration system 100 and as the second shield of the magnetic field to the user and the exterior environment so as to fulfill the recommended standard (<40 mT) by WHO and ICNIRP. The housing case 003 can be made of magnetic-shielding material such as soft iron.

According to the present invention, the system 100 could be used for treating musculoskeletal indications. Alternatively, it could be used as a prophylactic device for addressing the issue.

Although the above descriptions include many specific arrangements and parameters, it should be noted that these specific arrangements and parameters only served to illustrate one embodiment of the present invention. This should not be considered as the limitations on the scope of the invention. It can be understood by those skilled in the art that various modifications, additions and substitutions may be made thereto without departing from the scope and spirit of the present invention. Therefore, the scope of the present invention should be construed on the basis of the appended claims.

The invention claimed is:

1. A magnetic levitation vibration system, comprising:

a top plate having a top surface and a bottom surface;

a base plate located under the top plate and having a top surface and a bottom surface, the top surface of the base plate facing the bottom surface of the top plate;

at least one first magnet fixed on the bottom surface of the top plate;

at least one second magnet fixed on the top surface of the base plate in alignment with the first magnet with an equivalent polarity facing the first magnet to maintain a repulsive force between the first and second magnets, whereby the first and second magnets levitate the top plate during vibration thereof;

at least one electromagnetic actuator comprising an upper half fixed on the bottom surface of the top plate and a lower half fixed on the top surface of the base plate in alignment with the upper half, whereby the electromagnetic actuator provides a vibrating force for the top plate independent from the first and second magnets during vibration of the top plate;

a controller configured to adjust a frequency of vibration of the top plate;

a sensor configured to monitor a magnitude of vibration of the top plate during vibration thereof to generate monitored signals; and a control circuit electrically connected to the lower half of the actuator and configured to adjust the magnitude of vibration of the top plate in real time or periodically during vibration of the top plate in response to the monitored signals.

2. The magnetic levitation vibration system of claim 1, wherein the top plate and the base plate are separated from each other.

3. The magnetic levitation vibration system of claim 1, wherein the first and second magnets are permanent magnets.

4. The magnetic levitation vibration system of claim 1, wherein the upper half of the actuator is a permanent magnet, the lower half of the actuator is a coil.

5. The magnetic levitation vibration system of claim 1, wherein the control circuit comprises a signal generator for producing vibration signals;

a power amplifier magnifying the vibration signals to drive the electromagnetic actuator;

an AC/DC converter for realizing AC/DC conversion;

a comparator for comparing the monitored signals obtained from the sensor with a reference so as to control the signal generator in light of a result of a comparison; and a timer controlling a duration of one treatment.

6. The magnetic levitation vibration system of claim 1, wherein the sensor is an accelerometer.

7. The magnetic levitation vibration system of any one of claims 1 to 6, further comprising a set of guide devices.

8. The magnetic levitation vibration system of claim 7, wherein the set of guide devices comprise at least one guide pole fixed on one of the top and base plates and at least one guide tube fixed on the other plate.

9. The magnetic levitation vibration system of claim 8, further comprising at least one washer fixed at one end of the guide pole.

10. The magnetic levitation vibration system of claim 1, wherein each of the top surface of the top plate and the bottom surface of the bottom plate is covered with a thin metal sheet.

11. The magnetic levitation vibration system of claim 1, further comprising a case configured to package the top and base plates and shield a magnetic field from interior of the case to exterior.

12. The magnetic levitation vibration system of claim 1, further comprising at least three feet fixed on the bottom surface of the base plate.

13. A method for treating musculoskeletal indications, comprising:

providing a top plate having a top surface and a bottom surface;

providing a base plate located having a top surface and a bottom surface, the top surface of the base plate facing the bottom surface of the top plate;

generating a first magnetic field to levitate the top plate;

generating a second magnetic field to drive the top plate into vibration, independent from the generation of the first magnetic field;

adjusting a frequency of vibration of the top plate by controlling a frequency of an alternating current inducing the second magnetic field; and adjusting a magnitude of vibration of the top plate by controlling the current in real time or periodically in response to monitored signals transmitted by a sensor.

14. The method for treating musculoskeletal indications of claim 13, wherein the top plate and the base plate are separated from each other.

15. The method for treating musculoskeletal indications of claim 13, wherein the first magnetic field is generated by at least one pair of permanent magnets provided on the bottom surface of the top plate and on the top surface of the base plate, respectively.

16. The method for treating musculoskeletal indications of claim 13, wherein the second magnetic field is generated by an actuator consisting of a permanent magnet and an electromagnetic coil, and an oscillating force is provided by the second magnetic field to drive the top plate into vibration when the current is fed to the electromagnetic coil.

17. The method for treating musculoskeletal indications of claim 13, wherein adjusting magnitude of vibration of the top plate comprises:

producing a vibration signal;

magnifying the vibration signal to drive the electromagnetic coil;

conditioning the signals transmitted by the sensor to filter out vibrating voltage and pick out a level of vibration magnitude;

comparing the signals transmitted by the sensor with a reference; and adjusting the vibration signal in light of a result of a comparison.

18. The method for treating musculoskeletal indications of claim 13, wherein the sensor is an accelerometer.

19. The method for treating musculoskeletal indications of any one of claims 13 to 18, further comprising guiding a direction of vibration.

20. The method for treating musculoskeletal indications of claim 19, wherein guiding the direction of vibration is implemented by a set of guide devices which comprises at least one guide pole fixed on one of the top and base plates, at least one guide tube fixed on the other plate, and at least one washer fixed at one end of the guide pole.

21. The method for treating musculoskeletal indications of claim 13, further comprising shielding a human body standing on the top plate from the first and second magnetic fields.

22. The method for treating musculoskeletal indications of claim 13, further comprising supporting the base plate by at least three items with adjustable heights.

23. A method for preventing musculoskeletal indications, comprising:

providing a top plate having a top surface and a bottom surface;

providing a base plate located having a top surface and a bottom surface, the top surface of the base plate facing the bottom surface of the top plate;

generating a first magnetic field to levitate the top plate;

generating a second magnetic field to drive the top plate into vibration, independent from the generation of the first magnetic field;

adjusting a frequency of vibration of the top plate by controlling a frequency of an alternating current inducing the second magnetic field; and adjusting a magnitude of vibration of the top plate by controlling the current in real time or periodically in response to monitored signals transmitted by a sensor.

24. The method for preventing musculoskeletal indications of claim 23, wherein the second magnetic field is generated by an actuator consisting of a permanent magnet and an electromagnetic coil, and an oscillating force is provided by the second magnetic field to drive the top plate into vibration when the current is fed to the electromagnetic coil.

25. The method for preventing musculoskeletal indications of claim 23, wherein adjusting magnitude of vibration of the top plate comprises:

producing a vibration signal;

magnifying the vibration signal to drive the electromagnetic coil;

conditioning the signals transmitted by the sensor to filter out vibrating voltage and pick out a level of vibration magnitude;

comparing the signals transmitted by the sensor with a reference; and adjusting the vibration signal in light of a result of a comparison.

* * * * *